US005199592A

United States Patent [19]

Reiland et al.

[11] Patent Number: 5,199,592

[45] Date of Patent: Apr. 6, 1993

[54] CONTAINER WITH LATCHABLE HINGED SIDEWALL GATE

[75] Inventors: Cheryl M. Reiland; Mark Hillis, both of Tacoma, Wash.

[73] Assignee: Perstorp Extec, Inc., Tacoma, Wash.

[21] Appl. No.: 852,760

[22] Filed: Mar. 17, 1992

Related U.S. Application Data

[60] Continuation of Ser. No. 554,047, Jul. 17, 1990, abandoned, which is a division of Ser. No. 323,684, Mar. 15, 1989, Pat. No. 4,967,927.

[51] Int. Cl.[5] ..... B65D 7/00

[52] U.S. Cl. ..... 220/335; 220/338; 16/366

[58] Field of Search ..... 16/366, 367, 370; 220/335, 334, 336, 338, 340, 342, 343

[56] References Cited

U.S. PATENT DOCUMENTS

| | | | |
|---|---|---|---|
| 2,301,465 | 11/1942 | Shields | 16/366 |
| 3,349,939 | 10/1967 | Averill . | |
| 3,556,338 | 1/1971 | Wilkinson . | |
| 3,600,742 | 8/1971 | Barger | 16/366 |
| 3,682,348 | 8/1972 | Roberts | 220/335 |
| 3,964,636 | 6/1976 | Rehrig . | |
| 3,985,258 | 10/1976 | Quigley et al. . | |
| 3,998,327 | 12/1976 | Box . | |
| 4,000,827 | 1/1977 | Emery . | |
| 4,020,967 | 5/1977 | Hammond et al. . | |
| 4,062,467 | 12/1977 | Friedrich . | |
| 4,098,429 | 7/1978 | Hodge | 220/335 |
| 4,275,942 | 6/1981 | Steidl | 220/335 |
| 4,375,265 | 3/1983 | Van de Wetering et al. . | |
| 4,466,541 | 8/1984 | Tabler et al. . | |
| 4,534,079 | 8/1985 | Tucker | 16/366 |
| 4,572,401 | 2/1986 | Grenier | 220/335 |
| 4,624,381 | 11/1986 | Friedrich . | |
| 4,630,747 | 12/1986 | Chiang . | |
| 4,663,803 | 5/1987 | Gora . | |
| 4,674,647 | 6/1987 | Gyenge et al. . | |
| 4,684,017 | 8/1987 | Watanabe et al. | 220/338 |
| 4,742,598 | 5/1988 | Bruneau | 220/335 |
| 4,917,255 | 4/1990 | Foy et al. . | |
| 4,923,079 | 5/1990 | Foy . | |
| 4,967,927 | 11/1990 | Reiland . | |

FOREIGN PATENT DOCUMENTS

| | | |
|---|---|---|
| 0067326 | 12/1982 | European Pat. Off. . |
| 2734964 | 2/1979 | Fed. Rep. of Germany . |
| 3347367 | 7/1985 | Fed. Rep. of Germany . |
| 3500427 | 10/1986 | Fed. Rep. of Germany . |

OTHER PUBLICATIONS

"XYTEC Collapsible Containers", *Modern Material Handling*, September, 1986, advertisement.

"JIT Corporation, a Fursion of Form and Function", approximately July or August, 1986, pamphlet.

*Primary Examiner*—Joseph Man-Fu Moy

*Attorney, Agent, or Firm*—Townsend and Townsend

[57] ABSTRACT

A container having an opening in a sidewall coverable by a hinged gate is described. The hinge for the gate is made by mating two, preferably identical, hinge bodies to thereby insert posts on the hinge into sockets residing, respectively, in the gate and sidewall. The hinge rotates with respect to the gate about a first axis, and rotates with respect to the sidewall about a second spaced parallel axis. The gate, in the opened position, lies flat against the sidewall and is entirely clear from the opening. The gate is latched in its closed position by a clip structure which passes through a first lip of the gate, then through a lip of the sidewall, then through a second lip of the gate.

3 Claims, 8 Drawing Sheets

CONTAINER WITH LATCHABLE HINGED SIDEWALL GATE

This is a continuation of application Ser. No. 07/554,047 filed Jul. 17, 1990, now abandoned, which is a division of application Ser. No. 07/323,684 filed Mar. 15, 1989, now U.S. Pat. No. 4,967,927.

The present invention relates to a container with upright container walls having a gated opening in at least one wall, and, in particular, to a latching device to latch said gate in a closed position and a hinging device for opening said gate.

BACKGROUND OF THE INVENTION

Containers used for handling and shipping materials are well known and found in a range of sizes and uses. Materials handling containers have found increasing use with the introduction of "just-in-time" production methods. Such containers are often produced in a foldable or collapsible form in order that return shipping of the containers will require a minimum of space. To assure the desired stackability of the containers, the containers, as return-shipped, should contain a regular profile without latches, hinges, or other items substantially protruding therefrom.

Certain types of containers include an opening in a container sidewall, often closeable with a gate which can, e.g., be hinged to the sidewall. The gated opening is provided to allow ready access to the container contents when access through the top is impractical, such as when the top is covered, when the containers are stacked, or when the container is at an elevation to make access through the top opening impractical.

Several difficulties have been encountered in connection with such gates. Typically, the gate is hinged such that, when fully open, it does not lie absolutely flush against the container sidewall, but extends at some angle.

A second difficulty encountered with such gates is that conventional hinging, such as knuckle-and-pin hinges, tends to be relatively expensive to use and repair. In addition to the hinge hardware being expensive, particularly when metallic hinges are used, conventional hinging is relatively labor-intensive to construct and attach. Conventional hinging typically involves a number of differently configured parts and additional expense is involved in maintaining an accounting for an inventory of such parts, during both construction and repair processes.

Yet another difficulty with present gate construction relates to a type of construction in which the pivot for the gate is formed as part of the gate itself, such as integral formation of hinge structures along an edge of the gate. This type of construction is generally described in U.S. Pat. No. 4,674,647, issued Jun. 23, 1987, to Gyenge, et al. While this type of construction has a number of advantages, since the pivoting portions and the body of the gate are integrally formed, the entire gate has typically been molded of a material which has the strength needed for hinging or pivoting purposes.

Still another difficulty with current gated containers has been the tendency for latches, intended to hold a gate in a closed position, to break, especially when the container conveys heavy and/or loose parts.

SUMMARY OF THE INVENTION

The present invention provides a gated sidewall and a hinging device and latching device for use therewith. The present invention has involved the recognition that when an opened gate is not flush against a sidewall, there is a tendency for the gate to catch or snag and a risk of damage to the gate edge. A gate 2, extending outward from the sidewall 4 at an angle 5, in the manner depicted schematically in FIG. 13, has been found liable to catch or snag on other items, such as when the container is being conveyed past an assembly line. Further, in such a protruding condition, the hinged edge 6 of the gate extends a distance 7 into the openings, which not only increases the likelihood of catching or snagging, such as when materials are moved through the opening, but also renders the gate edge 6 susceptible to damage from impact with items being removed from or placed into the container. The present invention includes a hinge of a toggle type which provides two axes of rotation. A first axis of rotation is that about which the hinge rotates with respect to the sidewall. A second axis of rotation is that about which the hinge rotates with respect to the gate. By using such a toggle hinge, the gate, according to the present invention, lies flat against the container sidewall Furthermore, the gate in the opened position, according to the present invention, entirely clears the sidewall opening.

According to the present invention, the hinge is provided as a two-part, snap-together composite hinge. The hinge, being separate from the gate, can be made of high-strength plastic, reducing the need for excessively high-strength (and expensive) gate material. Preferably, the two parts of the hinge are identical, so that the inventory of different parts which must be maintained is reduced. Use of identical parts also decreases the tooling costs involved in overall production of the container.

The present invention also includes the recognition that many instances of latch failure, described above, occur when latches are designed as a clip extending through one lip of the gate and one lip of the sidewall. According to the present invention, the gate includes an interleaved structure with a clip passing through a first gate lip, then through a sidewall lip, and finally through a second gate lip. It has been found that such construction is less susceptible to breakage than previous latching devices, such as described, for example, in U.S. Pat. No. 4,674,647, issued Jun. 23, 1987, to Gyenge, et al.

Both the clip and the hinge are provided in a flat configuration to be contained entirely within the profile of the collapsed container to maintain stackability thereof.

DETAILED DESCRIPTION OF THE PREFERRED EMBODIMENT

Figure 1:
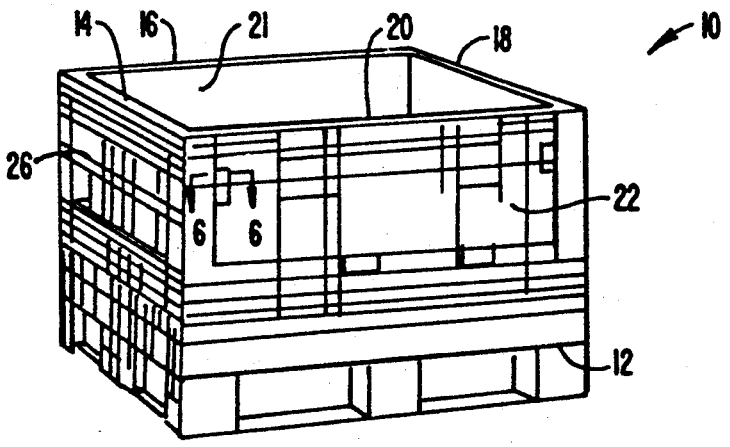
FIG. 1 is a perspective view of an erect container according to the present invention.
Figure 2:
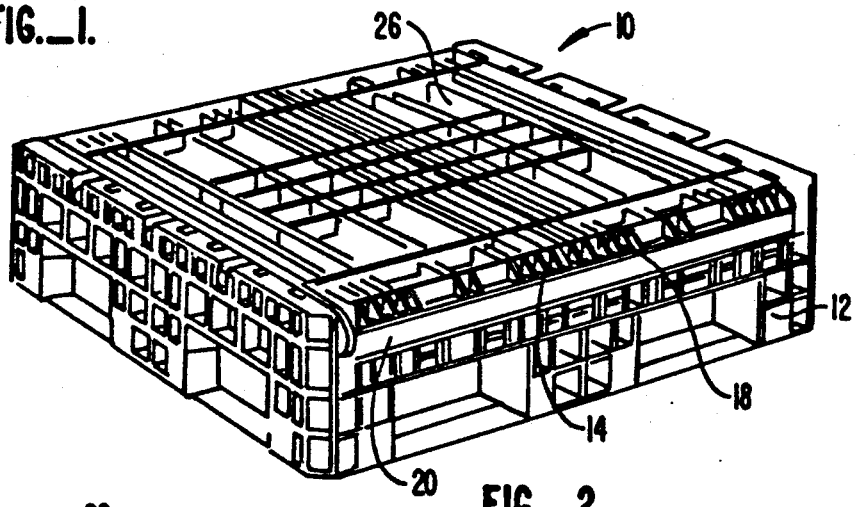
FIG. 2 is a perspective view of the container of FIG. 1, in a collapsed configuration.

The present invention relates to the hinging and latching of a gate, particularly usable to cover an opening in a container sidewall. Such a container can be of the type, depicted in FIG. 1, having a base 12 and substantially planar sidewalls 14, 16, 18, 20. Preferably, the container sidewalls 14, 16, 18, 20 can be folded into a position substantially parallel to the base 12, as depicted in FIG. 2. In this way, containers, after being used, can be shipped while occupying a minimum of space. As seen in FIG. 1, at least one of the sidewalls, e.g., the fourth sidewall 20, has attached to it a gate 22 for covering an opening 24 in the sidewall. Preferably, the container is of a pallet type to permit transportation by a forklift, and is designed for nesting when stacked either in the erect or collapsed configuration. Preferably, the container is designed so as to receive a lid structure of appropriate configuration.

The container 10, including the gate 22, can be made of a number of materials. Preferably, the entire container is formed by injection-molded plastic techniques. The structure is most advantageously formed of a material, such as high-density polyethylene. The thickness of the sidewalls and base will be determined by the strength and durability requirements for any particular container. Ribbing or reinforcement 26 may be provided for wall members in a pattern according to principles well known in the art. Preferably, the inside surfaces 21 of the sidewalls 14, 16, 18, 20 and base 12 are smooth and free of obstructions, so as to be easily cleaned and to prevent damage to sensitive contents.

Figure 3:
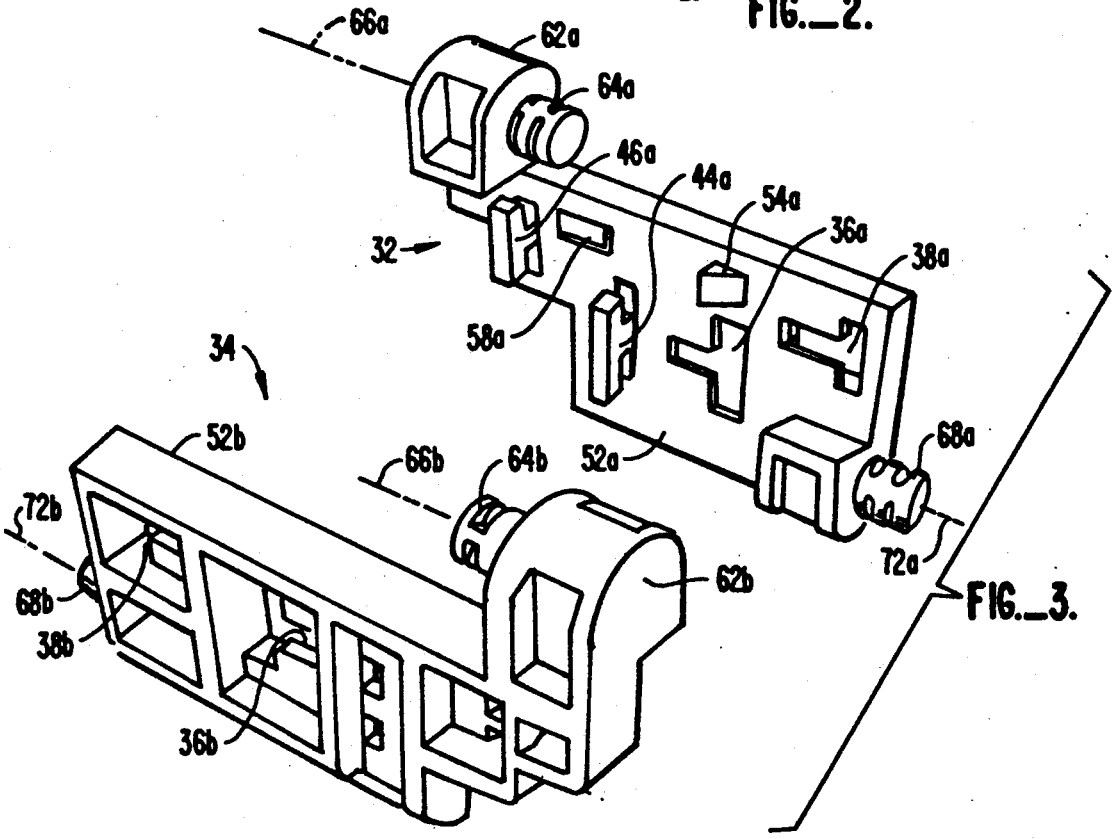
FIG. 3 is an exploded perspective view of the hinge of the present invention.
Figure 4:
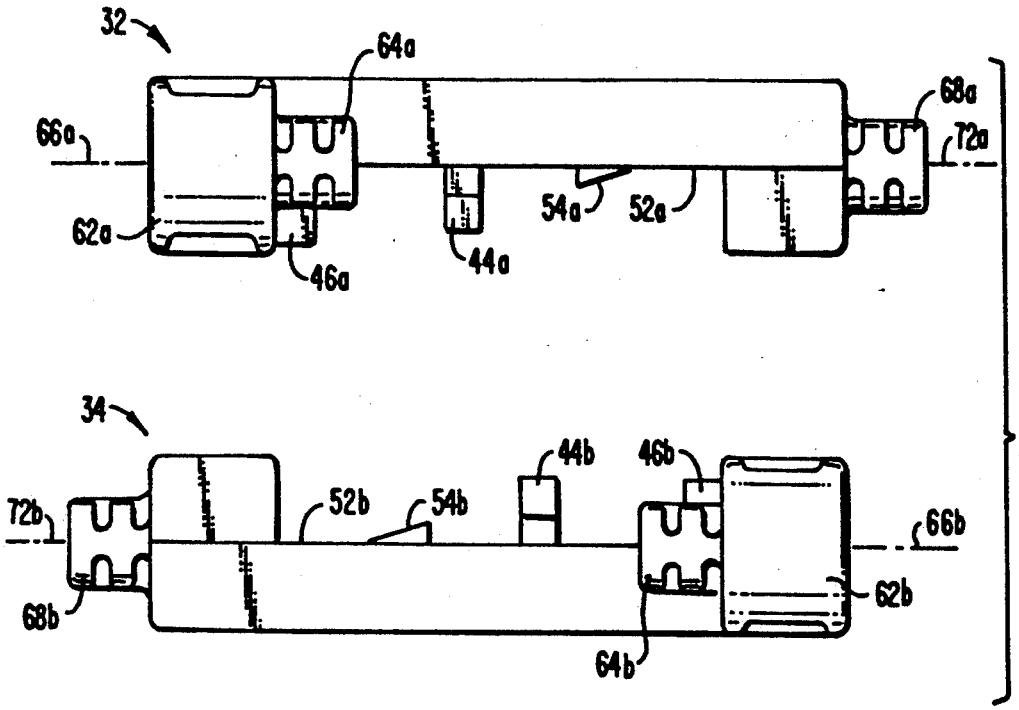
FIG. 4 is an exploded top view of the hinge of the present invention.
Figure 5:
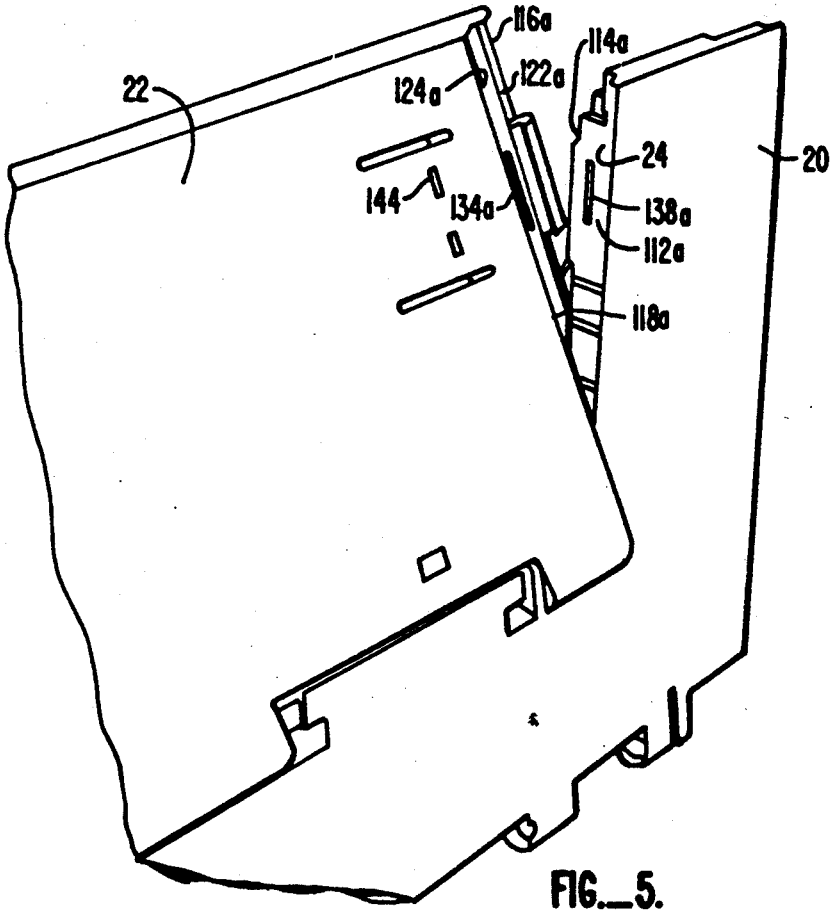
FIG. 5 is a perspective rear view of a portion of the sidewall of the container of FIG. 1, with a partially opened gate.

The gate 22 is joined to the sidewall 20 using at least one, and preferably two, hinging device 28, 29. As best seen in FIGS. 3 and 4, the hinging device 28 is provided by joining first and second hinge bodies 32, 34. In the preferred embodiment, the hinge bodies 32, 34 are identical interlocking pieces. For this reason, in the preferred embodiment, the following description of the first hinge body 32 applies equally to the second hinge body 34.

The first hinge body 32 includes two slots 36*a*, 38*a*, which are substantially wider at one end than the other and are preferably T-shaped. The hinge body 32 also includes two T-shaped tangs 44*a*, 46*a*. The tangs 44*a*, 46*a* extend outwardly from a substantially flat sliding surface 52*a*. A locking tab 54*a* is formed on the sliding surface 52*a*, and has a shape corresponding to a receiving slot 58*a*, also formed on the sliding surface 52*a*. The first hinge body 32 has an arm 62*a* extending outward from the body with a first post 64*a* attached thereto. The first post 64*a* is substantially cylindrical in shape, defining a first axis 66*a*. A second post 68*a* extends outward from the first hinge body 32. The second post 68*a* is also substantially cylindrical, and defines a second axis 72*a*. The second hinge body includes slots 36*b*, 38*b*, tangs 44*b*, 46*b*, a sliding surface 52*b*, a locking tab 54*b*, a receiving slot 58*b*, an arm 62*b*, and two posts 64*b*, 68*b*. The posts 64*b*, 68*b* define third and fourth axes, 66*b*, 72*b*, respectively.

The gate 22 includes first and second recesses 74, 76. Formed in each recess 74, 76 are projections 78*a*, 78*b*, 78*c*, 78*d*, each projection having a socket 82*a*, 82*b*, 82*c*, 82*d* formed therein. The gate sockets 82*a*, 82*b*, 82*c*, 82*d* are of a size and shape to correspond with and receive the first posts 64*a*, 64*b*, 64*c*, 64*d*, respectively.

The fourth sidewall 20 also includes first and second recesses 84, 86. Each recess 84, 86 has two sockets 88*a*, 88*b*, 88*c*, 88*d* formed therein. The sockets 88*a*, 88*b*, 88*c*, 88*d* are of a size and shape to correspond with and to receive the second posts 68*a*, 68*b*, 68*c*, 68*d*, respectively.

When attaching the gate 22 to the sidewall 20, the gate 22 is first positioned in the opening 24. In this position, a large recess 92 is formed by the alignment of the first gate recess 74 and the first sidewall recess 84. The first hinge body 32 is positioned in the large recess 92, and is moved to insert the first post 64*a* into the corresponding gate socket 82*a* and the second post 68*a* into the corresponding sidewall socket 88*a*. Next, the second hinge body 34 is positioned above the first hinge body 32, generally in the configuration depicted in FIGS. 3 and 4, and the second hinge body 34 is placed adjacent to the first hinge body 32 to assume a first adjacent position. In the first adjacent position, depicted in FIG. 11, the tangs 44*a*, 46*b*, of the second hinge body 34 extend through and partially reside in the corresponding slots 36*a*, 38*a* of the first hinge body 32. Similarly, the tangs 44*a*, 46*a* of the first hinge body 32 extend through and reside partly in the corresponding slots 36*b*, 38*b* of the second hinge body 34.

Figure 12:
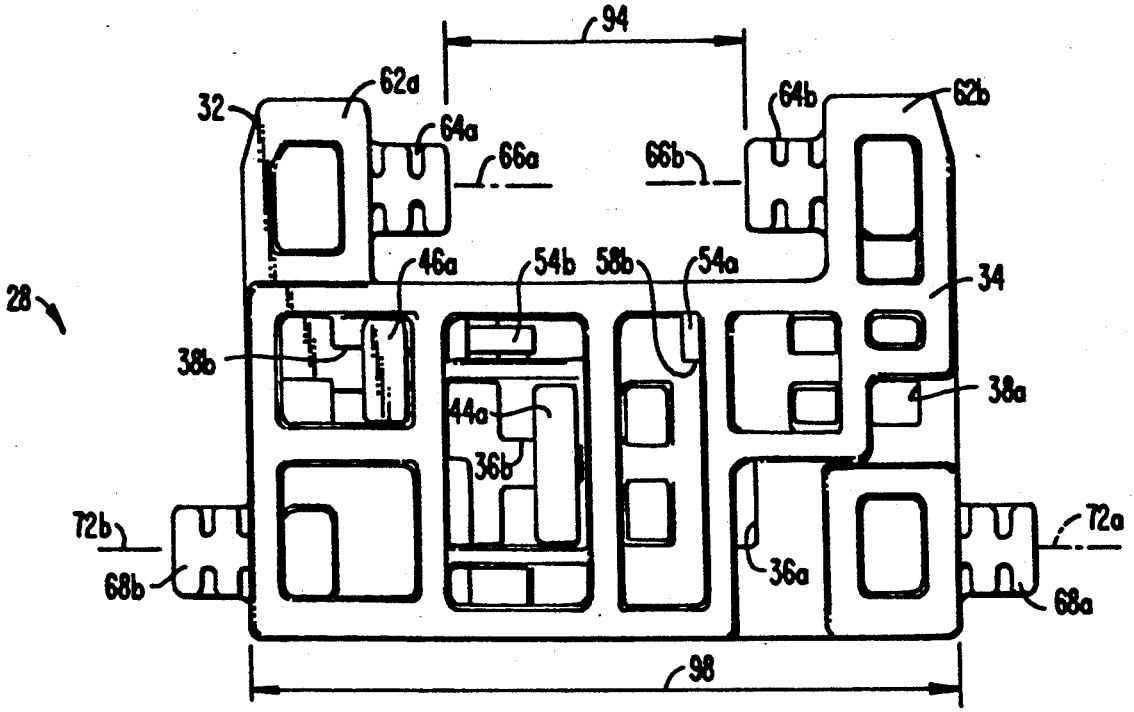
FIG. 12 is a front elevational view of the hinge in a final configuration.
Figure 11:
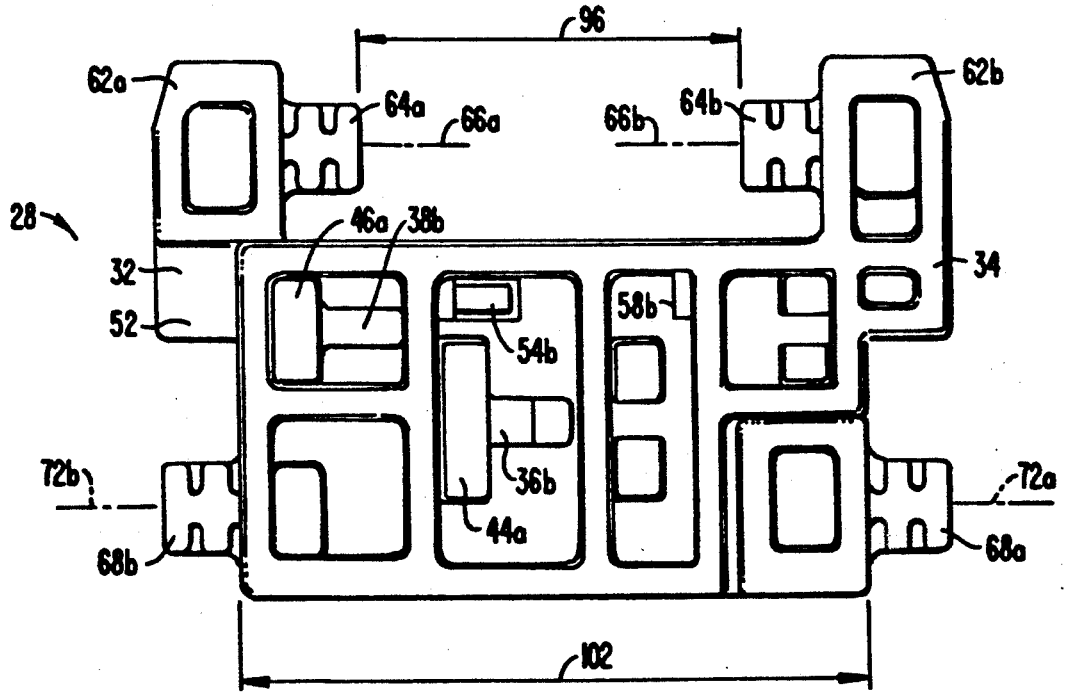
FIG. 11 is a front elevational view of the hinge in an initial position.
Figure 13:
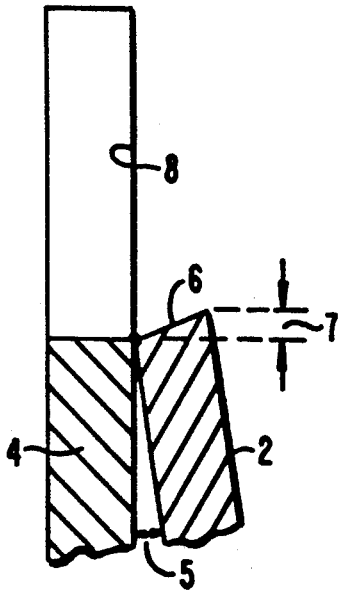
PRIOR ART FIG. 13.
FIG. 13 schematically depicts a cross-section through an open gate and sidewall, according to the prior art.

The second hinge body 34 is moved in a sliding manner, sliding the surfaces 52*a*, 52*b* across each other, to a second position, as depicted in FIG. 12. In the second position, the first post 64*b* and second post 68*b* of the second hinge body 34 are inserted into the corresponding sockets in the gate 82*b* and sidewall 88*b*. Also in this position, the locking tab 54*a* in the first hinge body 32 engages the receiving slot 58*b* in the second hinge body 34, and, conversely, the second body locking tab 54*b* engages the first body receiving slot 58*a* to retain the first and second hinge bodies 32, 34 in the described relative position. Preferably, the locking tab is of an unreleasable type such that, after the hinge device 28 is positioned as described, it cannot be readily removed. The first posts 64*a*, 64*b* of the first and second hinge bodies 32, 34 in the second position are substantially coaxial and separated by a distance 94, which is less than the distance 96 separating those posts when the first and second hinge bodies 32, 34 are in the first position, as depicted in FIG. 11. In the second position, the second posts 68*a*, 68*b* of the first and second hinge bodies 32, 34 are substantially coaxial and separated by a distance 98, which is greater than the distance 102 between those posts when the hinge bodies 32, 34 are in the first position, depicted in FIG. 11.

Figure 9:
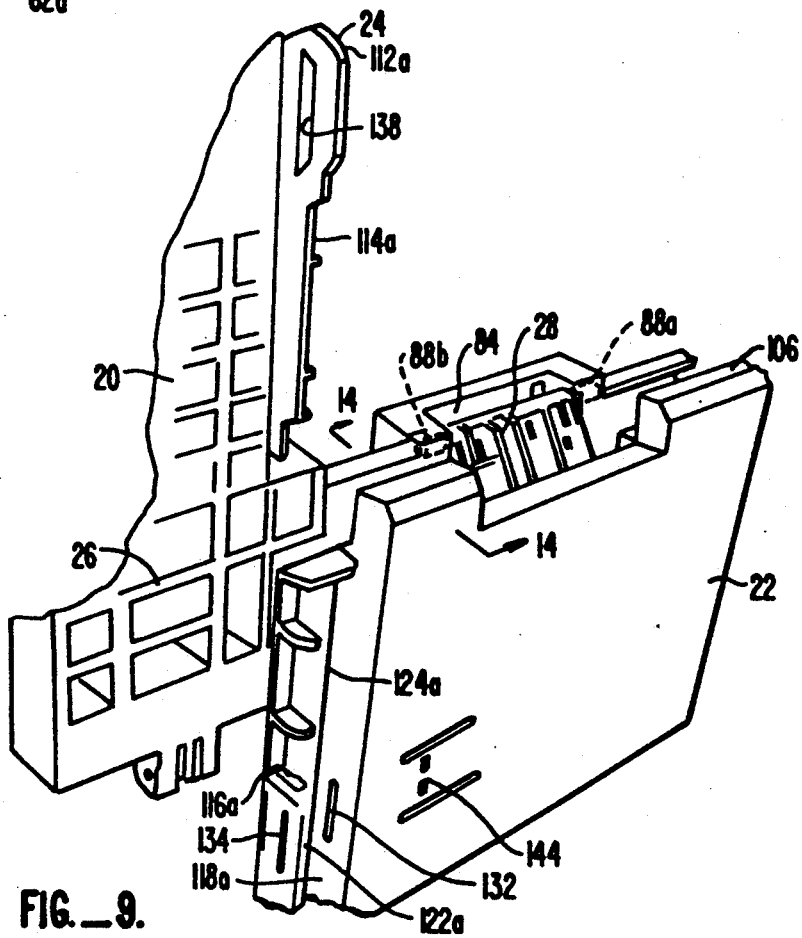
FIG. 9 is a front perspective view of a portion of the sidewall with the gate fully opened.
Figure 10A:
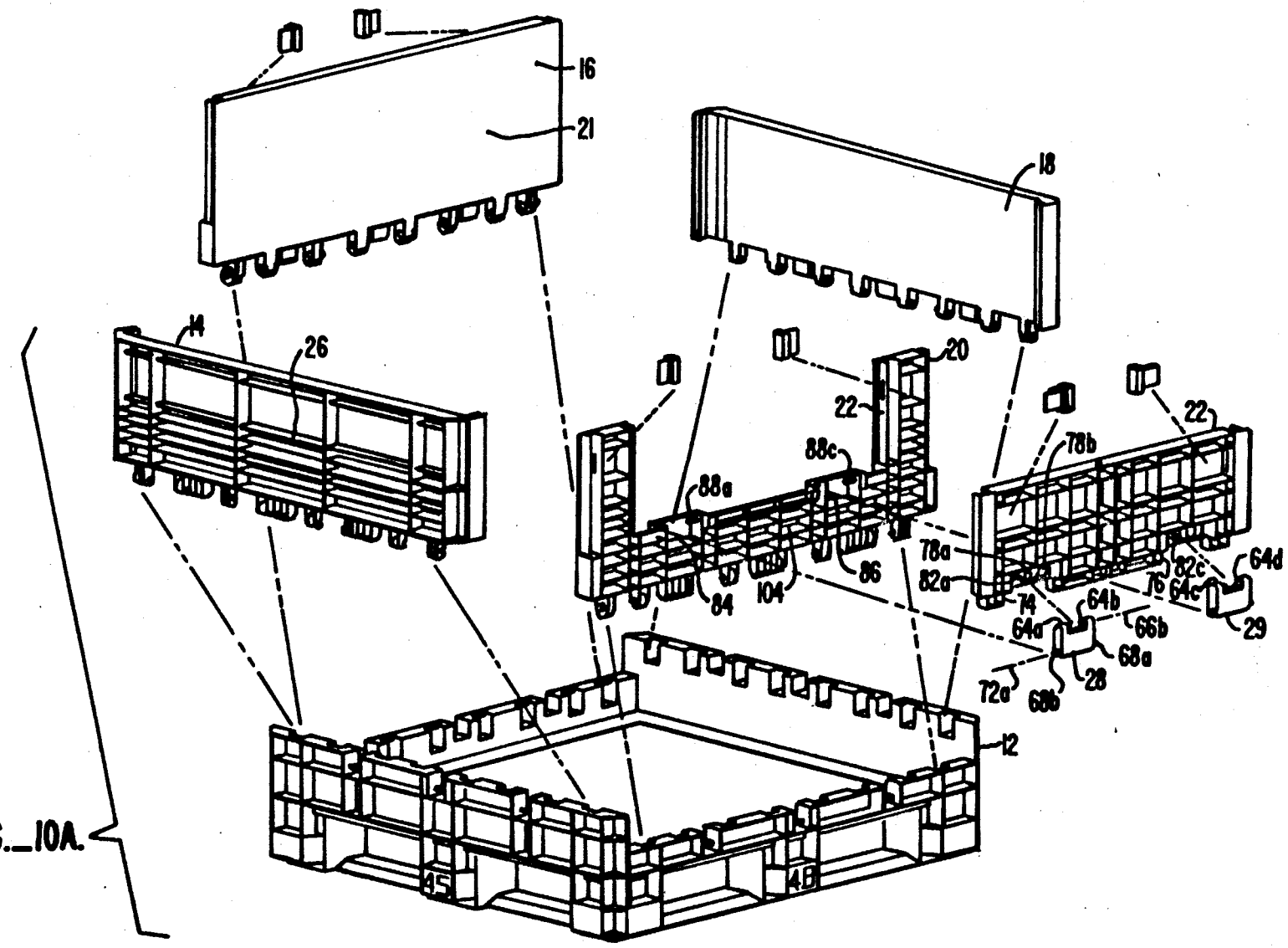
FIG. 10A is an exploded perspective view of the container depicted in FIG. 1.
Figure 10B:
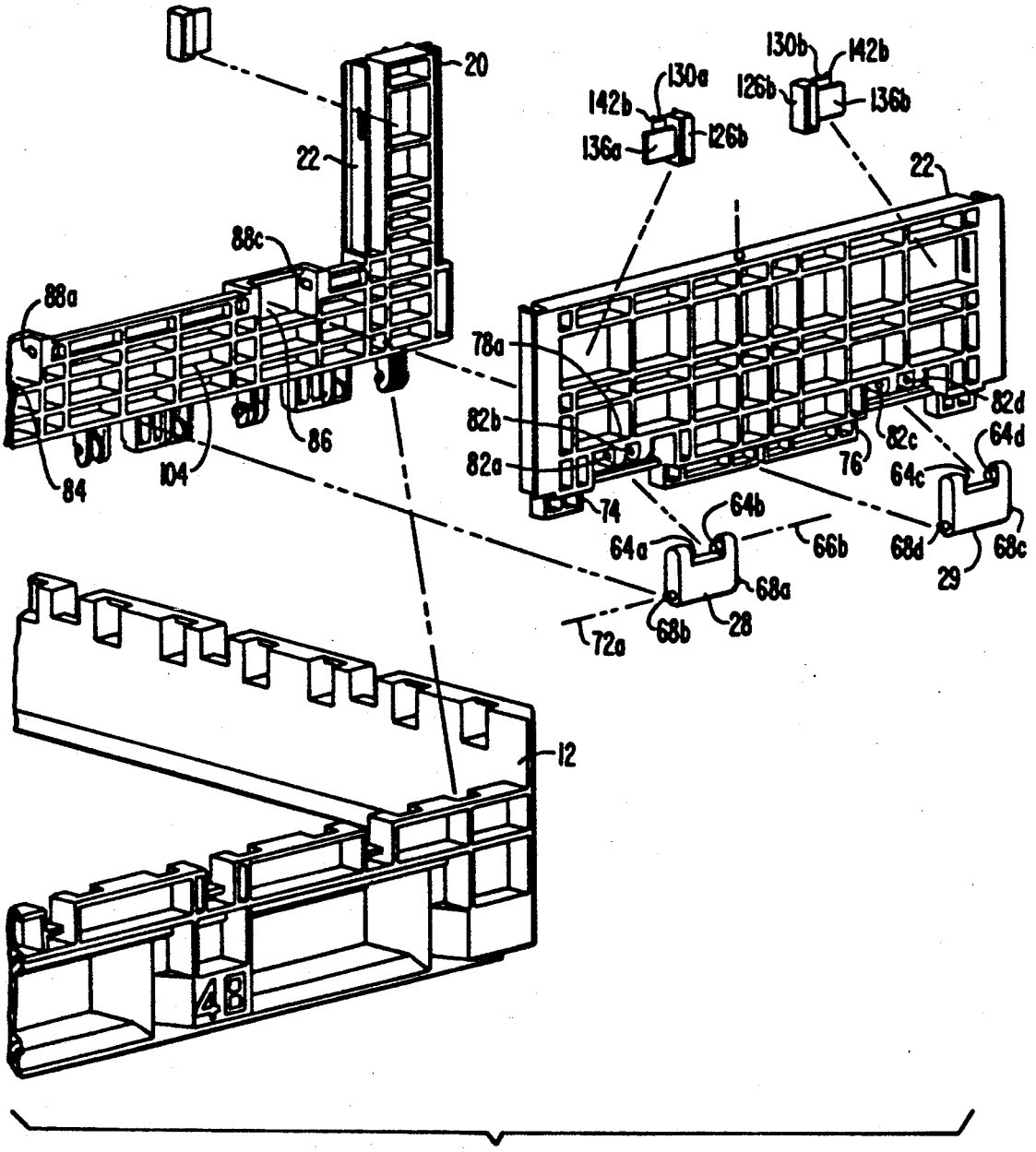
FIG. 10B is an enlarged view of the gate and opening portion of FIG. 10A.
Figure 14:
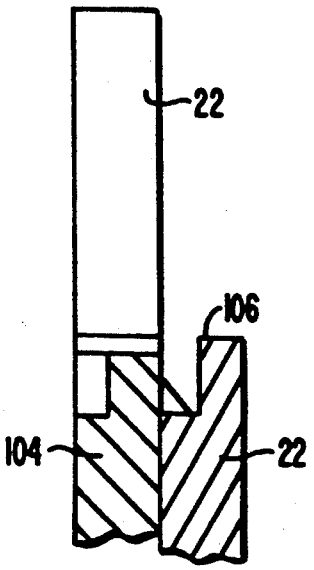
FIG. 14 is a partial cross-sectional view, taken along line 14—14, of FIG. 9.

The attachment of the second hinge device 29 is achieved by substantially the same process as that described above. In this manner, the hinge devices 28, 29 constitute toggle hinges, i.e., hinges having two axes of rotation. The hinges 28, 29 rotate with respect to the gate about the coaxial first and third axes 66*a*, 66*b*. Hinges 28, 29 rotate with respect to the sidewall 20 about coaxial second and fourth axes 72*a*, 72*b*, which are substantially parallel to and spaced from the axis 66*a*, 66*b* defined by the first posts 64*a*, 64*b*. As seen in FIGS. 9 and 14, by using such a toggle hinge, the gate 23 can be rotated a full 180° to lie substantially flat against, adjacent to, and parallel with a planar portion 104 of the sidewall 20. In this position, the gate 22 does not project outwardly from the plane of the planar portion 104 of the sidewall 20 at any significant angle. Furthermore, as seen in FIGS. 9 and 14, in the fully opened position, the hinged edge 106 of the gate 22 does not extend into the opening 24, thus ensuring that the opening 24 is entirely uncovered. By providing such a hinging structure, it is possible for the user to access the interior of the container with a lessened possibility of catching or snagging.

The opening 24 has first and second edges 112*a*, 112*b*. Formed along each of these edges 112*a*, 112*b* are sidewall lips 114*a*, 114*b*. The gate 22 similarly has first and second edges 116*a*, 116*b*. Along each of these edges 116*a*, 116*b* is formed an inner lip 118*a*, 118*b* and an outer lip 122*a*, 122*b*. The inner lips 118*a*, 118*b* and outer lips 122*a*, 122*b* are substantially parallel, and form between them a channel 124*a*, 124*b*, respectively. The channels 124*a*, 124*b* are of a size and shape to accommodate the sidewall lips 114*a*, 114*b*, respectively, when the gate 22 is in the closed position, as seen in FIG. 1.

Figure 6:
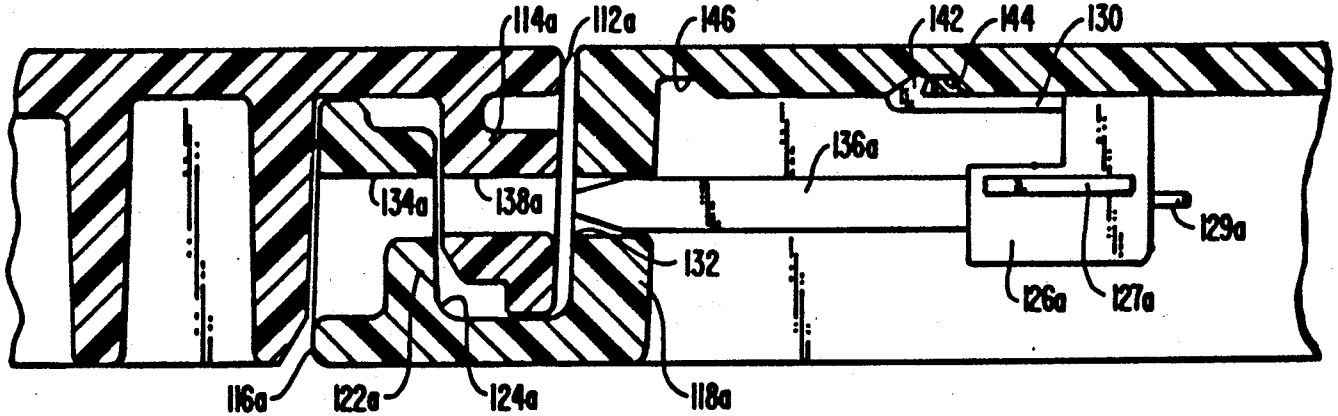
FIG. 6 is a cross-sectional view, taken along line 6—6 of FIG. 1, with the latch in the opened or unlatched position.
Figure 7:
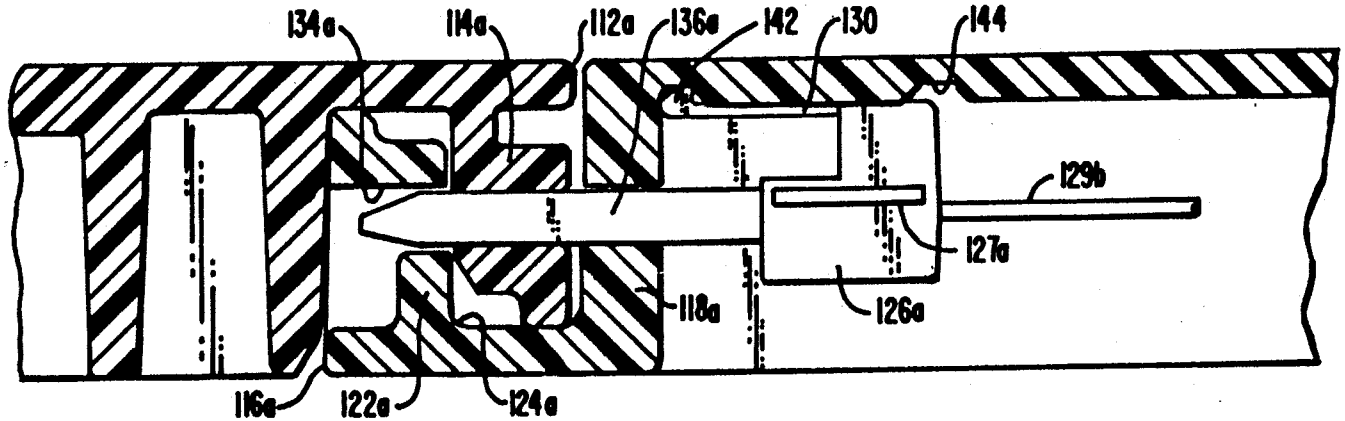
FIG. 7 is a cross-sectional view identical to the view of FIG. 6, except with the latch in the closed or latched position.
Figure 8:
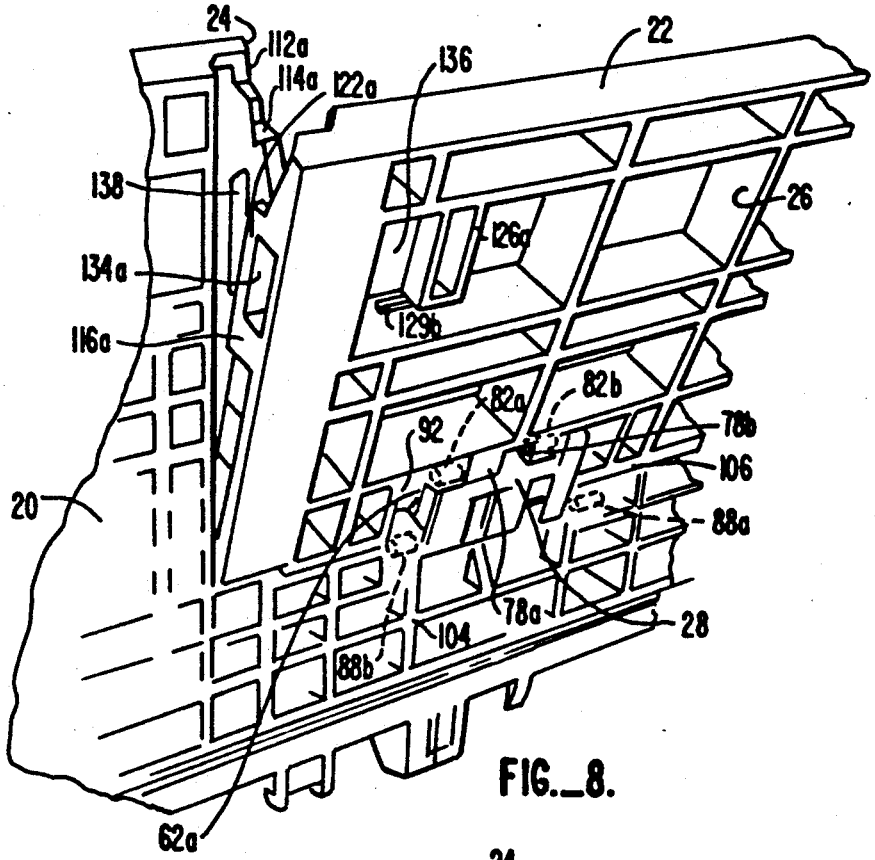
FIG. 8 is a front perspective view of a portion of the sidewall with the gate partially opened.

The gate 22 is latched in the closed position, using at least one, and preferably two, clips 126*a*, 126*b*. The clips 126*a*, 126*b* are slideably retained in the gate 22, e.g. by an upper tab 127*a* and lower tab (not shown), forced against an upper guiding rail (not shown) and a lower guiding rail 129*b* by an integral resilient spring 130. Positioning and movement of the clip 126*a* is further guided by placement of the tongue 136*a* in and through a hole 132 in the gate 22. The gate inner and outer lips 118, 122 contain aligned holes 132, 134 shaped to receive the tongue 136 of the clip 126. The sidewall lip 114 also contains a hole 138 which is configured to receive the clip tongue 136, and is positioned to be aligned with the gate holes 132, 134 when the gate 22 is in the closed position. The clip 126 is slideable from a first opened or unlatched position, as seen in FIG. 6, in which the tongue 128 is at a distance from the outer gate lip hole 134 and the sidewall lip hole 138 to a second position, as depicted in FIG. 7. In the second position, the clip tongue 136 extends through the gate inner lip hole 132, through the sidewall lip hole 138, and then through the outer gate lip hole 134. A tooth 142 at the end of the spring member 130 mates with recesses 144, 146 to releasably retain the clip 126 in the first or second position, as depicted in FIGS. 6 and 7, respectively.

It has been found that, by providing a clip which extends through three lips, i.e., the sidewall lip and, on either side, the inner gate lip and outer gate lip, the process of latching the gate in the closed position is less susceptible to failure, such as from breakage of portions of the latching structure. Without wishing to be bound by any theory, it is believed that this increased durability relates to the fact that, with the three-lip structure, any opening forces exerted on the gate 22 will be more symmetrically distributed and will be distributed over a larger surface area than with two or fewer lips.

In light of the above description, a number of advantages of the present invention are apparent. Because the gate is hinged such that it can be opened flush against the container sidewall, there is a lessened possibility of items catching or snagging on either the protruding gate itself or a portion of the hinged edge of the gate. There is a lessened likelihood that removal or insertion of items from or into the container will result in damage from impact with the gate edge. Because the hinge is preferably formed from two identical hinge bodies, there is a diminished tooling cost and a diminished cost for maintaining and accounting for the parts inventory. Because the hinge is separate from the gate, the hinge can be formed of a first, higher strength material to withstand the greater forces exerted on the hinge, and the gate can be made of a second, somewhat less expensive material. Because the latch or clip passes through three lip structures, the gate can be latched in the closed position so as to withstand severe shocks from shifting contents, with a diminished incidence of failure. Because the latches and hinges are flat and recessed, they do not interfere with stacking of the erect or collapsed containers.

As will be apparent to those skilled in the art, a number of variations and modifications of the described devices can be used. The present invention can be used in connection with many types of containers, and is not restricted to collapsible containers or pallet containers. Although the described devices are preferably made of plastic, they can also be made of other materials, such as metal, wood, or vitrifiable materials. A two-piece mating hinge could be made to accommodate non-parallel axes or non-spaced axes. A two-piece mating hinge could be made of parts which are not substantially identical. The T-shaped slots and tangs could be provided in other shapes, such as tapering slots and staunchion-shaped tangs. More or fewer tang-slot pairs could be used. The hinge bodies could be joined by other than a tang-slot configuration, such as deflectable fingers, hooks and eyes, bolting, gluing, welding, brazing, and the like. The clip could be made to pass through a second sidewall lip, after passing through the outer gate lip. The gate and sidewall could be designed with several interleaving lips through which the clip passes.

Although the description of the present invention has included a description of the preferred embodiments and certain variations and modifications, other variations and modifications of the invention can also be used, the invention being defined by the following claims.

What is claimed is:

1. A container, comprising:

a substantially planar base;

a sidewall having an exterior surface defining a plane, and, having an opening, the opening defined by a bottom edge and first and second side edges formed in said sidewall;

a gate attached by a hinge to said sidewall said gate having a bottom surface and first and second side edges;

said hinge rotatably attached to said sidewall defining a first axis of rotation;

said hinge rotatably attached to said gate to define a second axis of rotation;

said first axis being spaced from and substantially parallel to said second axis, wherein said gate is movable from a first portion to a second position, said gate, when in said first position substantially covering at least a portion of said opening without projecting in a direction outward from said container, beyond said first plane, and said gate, when in said second position, different from said first position uncovering the entirety of said opening; and first and second couplers said first coupler, releasably attaching said first side edge of said gate to said first side edge formed in said sidewall and said second coupler releasably attaching said second side edge of said gate to said second side edge formed in said sidewall, when said gate is in said first position.

2. A container, as claimed in claim 1, wherein at least a portion of said sidewall is foldable to a position substantially parallel to said base.

3. A container, as claimed in claim 1, further comprising:

a second hinge body rotatably attached to said sidewall defining an axis of rotation coaxial with said first axis; and said second hinge body being rotatably attached to said gate defining an axis of rotation substantially coaxial with said second axis of rotation.

* * * * *